US008942407B2

(12) United States Patent
Dodd et al.

(10) Patent No.: US 8,942,407 B2
(45) Date of Patent: Jan. 27, 2015

(54) LOUDSPEAKER AND DIAPHRAGM THEREFOR

(75) Inventors: Mark Alexander Dodd, Kent (GB); Jack Anthony Oclee-Brown, Kent (GB); Julia Davidson, Kent (GB)

(73) Assignee: GP Acoustics (UK) Limited, Maidstone (GB)

( * ) Notice: Subject to any disclaimer, the term of this patent is extended or adjusted under 35 U.S.C. 154(b) by 0 days.

(21) Appl. No.: 13/642,794

(22) PCT Filed: Apr. 26, 2011

(86) PCT No.: PCT/GB2011/000642

§ 371 (c)(1), (2), (4) Date: Dec. 6, 2012

(87) PCT Pub. No.: WO2011/135291

PCT Pub. Date: Nov. 3, 2011

(65) Prior Publication Data

US 2013/0070953 A1 Mar. 21, 2013

(30) Foreign Application Priority Data

Apr. 30, 2010 (GB) ..... 1007350.0

(51) Int. Cl.
*G10K 13/00* (2006.01)
*H04R 1/00* (2006.01)
(Continued)

(52) U.S. Cl.
CPC ..... *G10K 13/00* (2013.01); *B26B 21/225* (2013.01); *B26B 21/52* (2013.01); *B26B 21/521* (2013.01); *B26B 21/528* (2013.01); *H04R 1/00* (2013.01)
USPC ..... 381/398; 181/157; 181/166; 181/167; 181/170; 181/173

(58) Field of Classification Search
CPC ..... H04R 9/06; H04R 7/04; H04R 7/06; H04R 7/10
USPC ..... 381/398, 402, 423–426, 430–432, 353, 381/354; 181/157, 166–170, 173
See application file for complete search history.

(56) References Cited

U.S. PATENT DOCUMENTS 1,720,524 A * 7/1929 Menkens ..... 181/164
2,716,462 A * 8/1955 Brennan ..... 181/169
(Continued)

FOREIGN PATENT DOCUMENTS

DE 709710 C 8/1941
EP 1841280 A1 10/2007
(Continued)

OTHER PUBLICATIONS

PCT International Search Report, PCT/GB2011/000642, Aug. 22, 2011.
(Continued)

*Primary Examiner* — Davetta W Goins
*Assistant Examiner* — Oyesola C Ojo
(74) *Attorney, Agent, or Firm* — Westman, Champlin & Koehler, P.A.; Z. Peter Sawicki; Amanda Prose

(57) ABSTRACT

A loudspeaker radiating diaphragm can be stiffened to help increase the breakup frequency to above the working frequency range of the driver concerned, by forming it of a molded part and an attached formed part. The molded part is a radiating surface with stiffening ribs. The formed part is a thin surface of high modulus material, attached to the rear of the ribs. The overall structure can have significantly higher stiffness than either of the two parts. This helps in designing a loudspeaker driver that does not breakup within its working frequency range.

15 Claims, 3 Drawing Sheets

(51) Int. Cl.
*B26B 21/22* (2006.01)
*B26B 21/52* (2006.01)

(56) References Cited

U.S. PATENT DOCUMENTS

| | | | | | |
|---|---|---|---|---|---|
| 4,300,655 | A | * | 11/1981 | Sakamoto et al. | 181/167 |
| 4,351,412 | A | * | 9/1982 | Yamamuro et al. | 181/170 |
| 4,761,817 | A | | 8/1988 | Christie | |
| 4,764,968 | A | | 8/1988 | Kreitmeier | |
| 4,817,165 | A | * | 3/1989 | Amalaha | 381/425 |
| 6,445,803 | B1 | * | 9/2002 | Boon et al. | 381/184 |
| 8,068,634 | B2 | * | 11/2011 | Tsuchiya | 381/425 |
| 8,422,724 | B2 | * | 4/2013 | Corynen | 381/398 |
| 2004/0188175 | A1 | | 9/2004 | Sahyoun | |
| 2006/0088184 | A1 | * | 4/2006 | Ohashi et al. | 381/430 |

FOREIGN PATENT DOCUMENTS

| | | | |
|---|---|---|---|
| GB | 280424 | A | 11/1927 |
| GB | 2169471 | A | 7/1986 |
| WO | 0154455 | A1 | 7/2001 |
| WO | 2006042448 | A1 | 4/2006 |

OTHER PUBLICATIONS

PCT International Written Opinion, PCT/GB2011/000642, Aug. 22, 2011.
GB Office Action, GB1007350.0, Jun. 22, 2010.

* cited by examiner

LOUDSPEAKER AND DIAPHRAGM THEREFOR

CROSS-REFERENCE TO RELATED APPLICATION

This Application is a Section 371 National Stage Application of International Application No. PCT/GB2011/000642, filed Apr. 26, 2011 and published as WO/2011/135291 A1, in English, which claims priority of GB Application No. 1007350.0, filed Apr. 30, 2010 the contents of which are hereby incorporated by reference in their entirety.

FIELD OF THE INVENTION

The present invention relates to the field of loudspeakers, and particularly relates to diaphragms and loudspeakers comprising them.

BACKGROUND ART

The radiating diaphragm of a loudspeaker typically vibrates axially, with one side thereby creating pressure waves outside the loudspeaker enclosure. At certain frequencies, there are natural structural resonances in the diaphragm and other moving parts. When the diaphragm is driven by the voice coil, these resonances may be excited. They correspond to peak displacements of the diaphragm, but other than the main resonance (at which the diaphragm may move pistonically) the displacements are in the form of dynamic bending deformations. These deformations affect the magnitude and directivity of the radiated pressure, and are highly frequency dependent. They therefore adversely affect the sound of the loudspeaker. The lowest frequency at which this occurs is known as the "breakup frequency" of the driver.

For desirable radiated pressure the driver breakup must be controlled in one or more of a number of possible ways. The material or geometry of the deforming part may be designed for high stiffness, to increase the breakup frequency to above the working range of the driver. Alternatively, the material of the deforming part may be selected for high damping in order to reduce the magnitude of the deformation at resonance.

These approaches to controlling breakup operate in different ways, and so the most suitable approach will depend on other factors such as size, shape, working frequency range, moving mass target, cost etc.

Geometries that are commonly used to increase stiffness include cones and domes; their curvature gives them much greater stiffness compared to a flat diaphragm. Stiffening ribs may be added to the geometry; these generally protrude perpendicular to the diaphragm rear surface and extend in the direction of a resonance deformation to increase the frequency of that resonance.

Factors such as build height, moving mass target, costs and cosmetics may mean that diaphragms with the geometries above cannot give high enough breakup frequencies. This is especially true where the diaphragm must be flat to fit the driver within a shallow enclosure.

SUMMARY OF INVENTION

This invention primarily relates to a method of stiffening a radiating loudspeaker diaphragm to help increase the breakup frequency to above the working frequency range of the driver concerned.

The diaphragm consists of a moulded part and attached formed part. The moulded part is a radiating surface with stiffening ribs; its surface could be any shape, such as a cone, a dome, a flat disc, a rectangle etc. The ribs are most effective when they are perpendicular to the surface (that is, usually, parallel to the axis of motion) and run straight along the longer dimensions of the surface geometry (i.e. along the direction of resonance deformation). Additional ribs running at right angles to these may also be beneficial.

The second part is preferably formed as a thin surface of high elastic modulus material. It also may be a cone, dome, flat etc. It will ideally have the same profile as the rear of all or part of the ribs, and can be attached to the rear of the ribs.

Gaps or holes at the edge of the radiating surface, in the rib structure and in the formed surface can be provided, to allow air flow through the structure. Straight stiffening ribs within the structure would define an uninterrupted air channel, and in an assembly where the diaphragm is close to an otherwise enclosed pocket of air, this may be beneficial in avoiding high pressure fluctuations as the diaphragm vibrates. The holes could be sealed off in situations where air flow is not required.

The overall structure can have significantly higher stiffness than either of the two parts. This helps in designing a loudspeaker driver that does not breakup within its working frequency range.

An adhesive used to attach the two parts can be selected for flexibility and high damping. This may limit the overall stiffness of the structure, but will reduce the magnitude of resonance deformations.

The present invention therefore provides a diaphragm for a loudspeaker, comprising a radiating surface from which acoustic waves can be projected, a plurality of ribs, projecting away from the radiating surface in a direction transverse to the radiating surface, and at least one stiffening member, comprising a surface connected to the ribs and disposed axially offset from the radiating surface. The radiating surface has a first stiffness, and the surface of the stiffening member has a second, greater stiffness.

In an embodiment, the stiffening member is made from a material having an elastic modulus that is greater than that of the material forming the radiating surface.

The radiating surface and at least one stiffening member may take many shapes including conical, frustro-conical, domed and flat. They may have the same shape as each other or different shapes.

The plurality of ribs can comprise two or more ribs, each extending radially from a central region of the diaphragm toward an outer edge of the diaphragm. They can also comprise one or more ribs located at a point between a central region of the diaphragm and an outer edge of the diaphragm, and extending circumferentially.

The two or more radial ribs and the at least one stiffening member can define one or more air channels, for providing air flow through the diaphragm as described above.

There can be more than one stiffening members, such as a pair of stiffening members, each comprising a flat annular plate and with one being located within the other. The two annular plates are preferably located in a co-planar manner, more preferably also in a substantially concentric manner.

The plurality of ribs is ideally integrally moulded with the radiating surface. The at least one stiffening member can be attached to the plurality of ribs at a point on the rib furthermost from the radiating surface.

The at least one flat surface is preferably attached to the plurality of ribs by an adhesive. It will ideally be substantially parallel to the diaphragm.

The present invention also provides a loudspeaker, comprising a diaphragm as described above.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
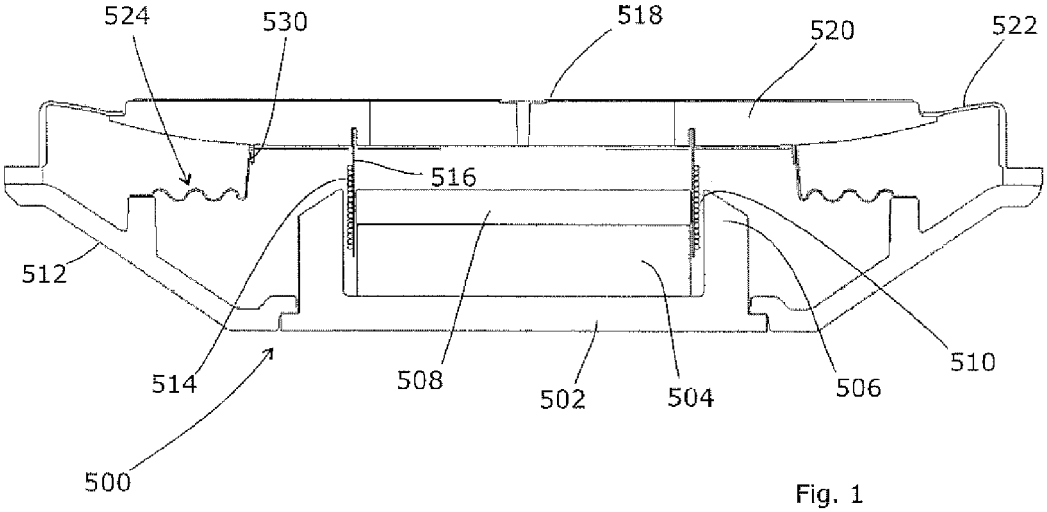
FIG. 1 shows a section through a loudspeaker according to the present invention.

FIG. 1 shows a loudspeaker driver 500. A magnet assembly 502 carries a permanent magnet 504 and a central pole piece 508, and has a cylindrical outer pole piece 506 to define a magnetic field gap 510. A chassis 512 sits concentrically around the magnet assembly 502 and provides support for the other parts of the driver 500.

These include a voice coil 514 that is supported on a voice coil former 516 so as to lie at least partly within the magnetic field gap 510. The voice coil former 516 drives a diaphragm 518, which has a planar front surface in order to reduce the overall depth of the driver 500 as compared to a driver comprising a cone-shaped diaphragm. To provide a degree of rigidity, the diaphragm has stiffening ribs 520 on its rear face, and the voice coil former 516 is attached to these.

At its radially outermost extent, the diaphragm 518 is supported by a surround 522 which helps to centre the diaphragm 518 relative to the magnetic field gap 510, acts as an air seal, and provides a restoring force to return the diaphragm 518 to its rest position (illustrated). To increase the restoring force to an adequate level, a suspension 524 is also provided. In the illustrated case, the suspension 524 is attached to suitable tabs 530 on circumferential stiffening ribs 536 (see FIG. 2).

Figure 2:
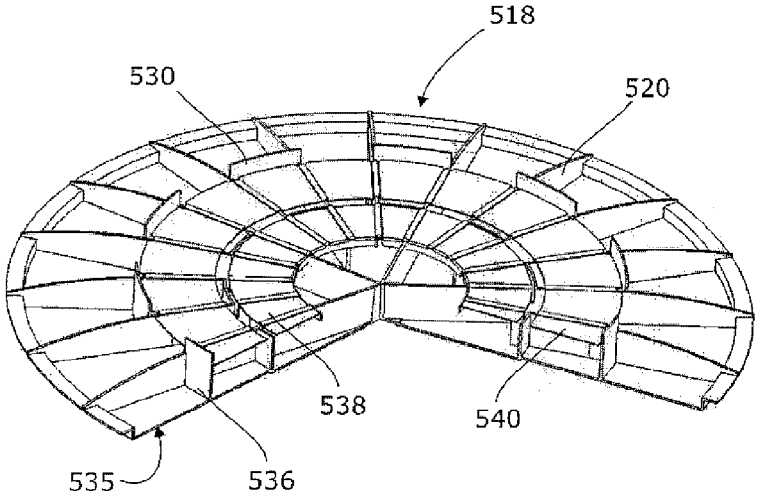
FIG. 2 shows a cut-away view of a diaphragm according to the present invention.
Figure 3:
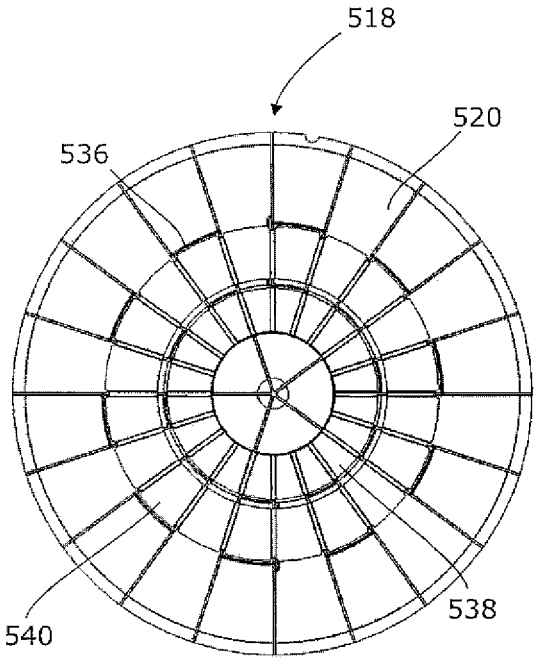
FIG. 3 shows an axial rear view of a diaphragm according to the present invention.
Figure 4:
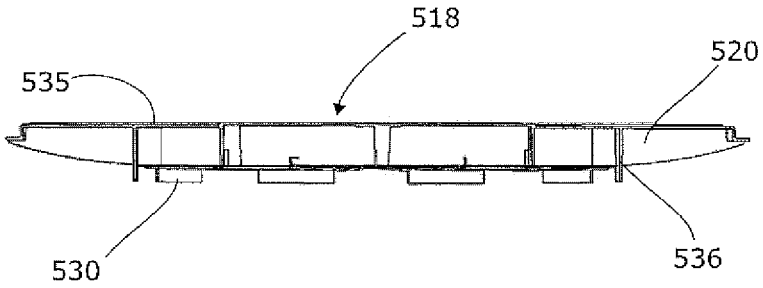
FIG. 4 shows a section of a diaphragm according to the present invention.

FIG. 2 shows in greater detail the rearmost face of the diaphragm 518 according to embodiments of the present invention. FIG. 3 shows the diaphragm 518 in rear plan view, and FIG. 4 shows the diaphragm in cross-section.

The diaphragm comprises a plurality of radially extending ribs 520, as previously described. These project rearwards and transverse to the main radiating surface 535 of the diaphragm. They also generally project radially, from a central region of the diaphragm to an outermost region of the diaphragm. A number of the radial ribs 520 extend right to the centre of the diaphragm, along its entire radius. Others of the radial ribs 520 are formed over only part of the radius of the diaphragm.

The diaphragm also comprises a number of circumferential ribs 536 projecting rearwards and transverse to the radiating surface 535. These are arranged circumferentially, so that they intersect with the radial ribs 520 at right angles.

In the illustrated embodiment, the circumferential ribs 536 are arranged to define two concentric circles. The concentric circles can be continuous or, as in the illustrated embodiment, non-continuous. The non-continuous circumferential ribs allow the definition of radial air channels, as will be described in greater detail below.

In one embodiment, the radiating surface 535, the radial ribs 520, the circumferential ribs 536 and the tabs 530 are all formed integrally from a single moulding of polymeric material.

The circumferential and radial ribs, both alone and in combination, provide a certain amount of rigidity to the diaphragm 518. However, this can be increased according to embodiments of the present invention by the provision of one or more stiffening members 538, 540.

The stiffening members 538, 540 each comprise a substantially flat surface running alongside and substantially parallel to the radiating surface 535, which is attached to one or more of the stiffening ribs 520, 536. The stiffening members 538, 540 may be shaped according to the rearmost profile of the ribs, to aid easy attachment thereto.

The stiffening members are formed from a material of higher modulus than the radiating surface.

In the illustrated embodiment, the stiffening members 538, 540 comprise a pair of annular plates, the smaller plate 538 radially within the larger plate 540. The two stiffening member 538, 540 are substantially coplanar and concentric. Conveniently they can be dimensioned to fit within the circumferential grooves defined by the circumferential ribs 536, to allow for consistent placement of the stiffening members relative to the diaphragm. However, this is not essential.

Alternative shapes are envisaged for the stiffening members 538, 540 and the rear profile of the ribs 520, 536 within the scope of the invention. For example, they could be conical, frustoconical, dome-shaped or flat.

It can be seen that the combination of radiating surface 535, radial ribs 520 and stiffening members 538, 540 serve to define radial air channels through the diaphragm 518 extending from the central region towards an outer region. In this case, the diaphragm 518, voice coil 514, former 516 and magnet assembly 502 form an enclosed pocket of air, and the air channels are beneficial in avoiding high pressure fluctuations here as the diaphragm vibrates.

Figure 5:
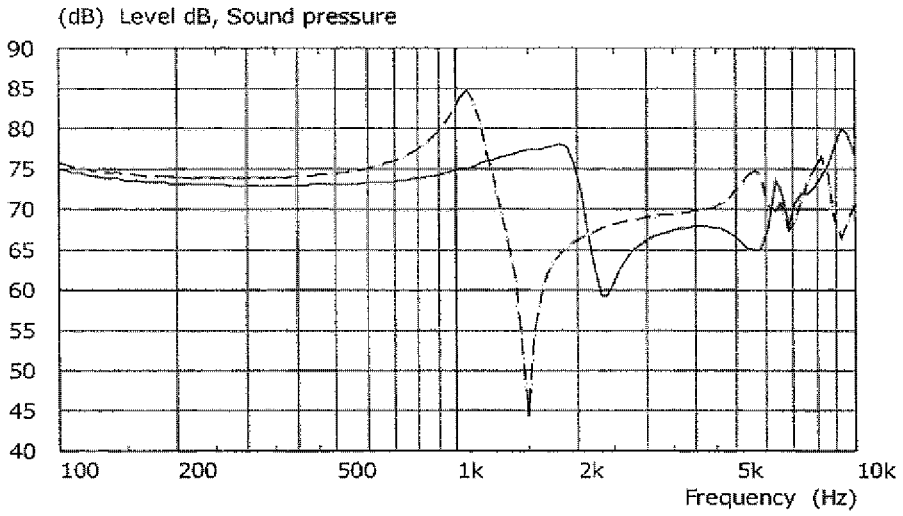
FIG. 5 shows frequency response curves for comparison between a loudspeaker comprising a diaphragm with a stiffening member according to the present invention and a loudspeaker comprising a diaphragm without a stiffening member.

FIG. 5 is a graph of the frequency response of a loudspeaker.

The dashed line shows the frequency response of a loudspeaker with a flat diaphragm having stiffening radial and circumferential ribs. It has no stiffening member but is otherwise similar to the diaphragms disclosed herein. The solid line shows the frequency response of a diaphragm according to embodiments of the present invention, with radial and circumferential ribs and a stiffening member as described above. It can be seen that the response of the stiffened diaphragm is regular up to a higher frequency than the conventional diaphragm. That is, the breakup frequency of the diaphragm has been increased.

The present invention therefore provides a diaphragm for a loudspeaker, in which one or more stiffening members are provided, comprising a surface running alongside and axially offset from the radiating surface. The stiffening members serve to increase still further the stiffness of the diaphragm, increasing the range of frequencies over which the loudspeaker can be used.

It will of course be understood that many variations may be made to the above-described embodiment without departing from the scope of the present invention.

The invention claimed is:

1. A diaphragm for a loudspeaker, comprising:

a radiating surface from which acoustic waves can be projected;

a plurality of ribs, projecting away from the radiating surface in a direction transverse to the radiating surface, the radiating surface and the ribs being formed integrally from a single moulding; and at least one stiffening member, comprising a surface connected to the ribs and extending substantially parallel to and alongside the radiating surface, wherein the material forming the radiating surface has a first stiffness, and wherein the stiffening member comprises a material having a second, greater stiffness.

2. The diaphragm of claim 1, wherein the plurality of ribs comprises two or more ribs extending radially from a central region of the diaphragm toward an outer edge of the diaphragm.

3. The diaphragm of claim 2, wherein the two or more radial ribs and the at least one stiffening member define one or more air channels for providing air flow through the diaphragm.

4. The diaphragm of claim 1, wherein the plurality of ribs further comprises one or more ribs located between a central region of the diaphragm and an outer edge of the diaphragm, and extending circumferentially.

5. The diaphragm of claim 4 comprising a pair of stiffening members, each comprising a flat annular plate, one being located within the other.

6. The diaphragm of claim 5, wherein the two annular plates are located in a co-planar manner

7. The diaphragm of claim 5, wherein the two annular plates are located in a substantially concentric manner.

8. The diaphragm of claim 4, wherein the or each circumferential rib is non-continuous.

9. The diaphragm of claim 1, wherein the at least one stiffening member is attached to the plurality of ribs at a point on one or more of the ribs furthermost from the radiating surface.

10. The diaphragm of claim 1, wherein the stiffening member is attached to the plurality of ribs by an adhesive.

11. The diaphragm of claim 1, wherein the radiating surface is formed in a shape that is one of conical, frustro-conical, domed or flat.

12. The diaphragm of claim 1, wherein the at least one stiffening member is formed in a shape that is one of conical, frustro-conical, domed or flat.

13. A loudspeaker, comprising the diaphragm of claim 1.

14. The diaphragm of claim 6, wherein the two annular plates are located in a substantially concentric manner.

15. A loudspeaker, comprising the diaphragm of claim 2, and further comprising a voice coil former for driving the diaphragm, the voice coil former being attached to the rear face of the radially extending ribs.

* * * * *